US009752243B2

(12) United States Patent
Hugot et al.

(10) Patent No.: US 9,752,243 B2
(45) Date of Patent: Sep. 5, 2017

(54) METHOD OF FABRICATING A BATH OF ELECTROLYTE FOR PLATING A PLATINUM-BASED METALLIC UNDERLAYER ON A METALLIC SUBSTRATE

(71) Applicant: SNECMA, Paris (FR)

(72) Inventors: Juliette Hugot, Jaunay-Clan (FR); Frederic Lagrange, Avanton (FR); Herve Molet, La Celle Saint Avant (FR)

(73) Assignee: SNECMA, Paris (FR)

( * ) Notice: Subject to any disclaimer, the term of this patent is extended or adjusted under 35 U.S.C. 154(b) by 0 days.

(21) Appl. No.: 14/395,190

(22) PCT Filed: Apr. 18, 2013

(86) PCT No.: PCT/FR2013/050855
§ 371 (c)(1),
(2) Date: Oct. 17, 2014

(87) PCT Pub. No.: WO2013/156737
PCT Pub. Date: Oct. 24, 2013

(65) Prior Publication Data

US 2015/0075996 A1 Mar. 19, 2015

(30) Foreign Application Priority Data

Apr. 19, 2012 (FR) ..... 12 53599

(51) Int. Cl.
*C25D 3/50* (2006.01)
*C23C 18/42* (2006.01)
(Continued)

(52) U.S. Cl.
CPC ..... *C25D 3/52* (2013.01); *C25D 3/50* (2013.01); *C25D 5/34* (2013.01)

(58) Field of Classification Search
CPC . C25D 3/52; C25D 3/56; C25D 3/567; C25D 3/50; C23C 18/42; C23C 18/44
(Continued)

(56) References Cited

U.S. PATENT DOCUMENTS 3,285,839 A * 11/1966 Camp ..... C25D 3/54 205/262
4,427,502 A 1/1984 Abys
(Continued)

FOREIGN PATENT DOCUMENTS

| | | | |
|---|---|---|---|
| EP | 0 465 073 | | 1/1992 |
| GB | 1003634 | * | 9/1965 |
| GB | 2 351 089 | | 12/2000 |

OTHER PUBLICATIONS

Rao et al. "Chemical and electrochemical depositions of platinum group metals and their applications" Coordination Chemistry Reviews 249 (2005) 613-631.*
(Continued)

*Primary Examiner* — Edna Wong
(74) *Attorney, Agent, or Firm* — Oblon, McClelland, Maier & Neustadt, L.L.P.

(57) ABSTRACT

The invention relates to a method of fabricating a bath of electrolyte for plating a platinum-based metal underlayer on a metallic substrate, comprising:

a) providing a first system having ligands and amine functional groups, the first system being constituted by an aqueous solution of an amino ligand comprising at least one compound $X—(NH_2)_n$, where X belongs to the group constituted by ($CH_3$, $CH_3—CH_2$, $CH_3—(CH_2)_m$), or $NH_3$ or an $xP^-(NH_4)^+_p$ salt where x is an acid radical belonging to the group constituted by ($PO_4^{3-}$, $HPO_4^{2-}$, $H_2PO_4^-$, $HPO_4^{2-}$and $H_2PO_4^-$, $SO_4^{2-}$, $HSO_4^-$, $H_2SO_4$, $HSO_4^-$, and $H_2SO_4$, $CH_3COO^-$,
(Continued)

$CH_3COOH$, and $CH_3COO^-$), or $H_2SO_4$, or $CH_3COOH$, and where n, m, and p are non-zero integers;

b) providing a second system forming a buffer system;

c) providing a third system providing a metallic salt, and constituted by an aqueous solution of platinum;

d) providing a fourth system suitable for imparting the conduction property to the medium; and e) mixing together the four systems so as to obtain the electrolyte bath.

10 Claims, 4 Drawing Sheets

(51) Int. Cl.
*C23C 18/44* (2006.01)
*C25D 3/52* (2006.01)
*C25D 5/34* (2006.01)

(58) Field of Classification Search
USPC ..... 205/242, 264, 67, 257; 106/1.21, 1.28
See application file for complete search history.

(56) References Cited

U.S. PATENT DOCUMENTS 5,298,280 A * 3/1994 Kaczur ..... C25B 9/08 427/125
5,310,475 A 5/1994 Kitada et al.
5,549,738 A 8/1996 Kitada et al.

OTHER PUBLICATIONS

Whalen et al. "Platinum from Aqueous Ammonium Hexachloroplatinate Solution" Journal of the Electrochemical Society, 152(11) C738-C743 (2005).*

Bates et al. "pH of Aqueous Mixtures of Potassium Dihydrogen Phosphate and Disodium Hydrogen Phosphate at 0° to 60° C." Journal of Research of the National Bureau of Standards, vol. 34, Apr. 1945.*

International Search Report Issued Jul. 8, 2013 in PCT/FR13/050855 Filed Apr. 18, 2013.

* cited by examiner

METHOD OF FABRICATING A BATH OF ELECTROLYTE FOR PLATING A PLATINUM-BASED METALLIC UNDERLAYER ON A METALLIC SUBSTRATE

The invention relates to a method of fabricating a bath of electrolyte for plating a platinum-based metallic underlayer on a metallic substrate.

Such metallic underlayers are used in particular for coating a substrate made of a metal part that needs to withstand high levels of mechanical and thermal stress in operation, and in particular a substrate made of superalloy. Such a thermomechanical part may in particular constitute a part for an aviation or terrestrial turbine engine. By way of example, said part may constitute a blade or a vane of the turbine in the turbine engine, and in particular in a high pressure turbine of an airplane turboprop or turbojet.

The search for increased efficiency from turbine engines, in particular in the field of aviation, and also for reducing fuel consumption and polluting emissions of gas and unburnt fuel have led to fuel combustion being performed closer to stoichiometric conditions. That situation is accompanied by an increase in the temperature of the gas leaving the combustion chamber and going to the turbine.

At present, the limiting temperature for use of superalloys is about 1100° C., while the temperature of the gas at the outlet from the combustion chamber or at the inlet of the turbine may be as high as 1600° C.

Consequently, it has been necessary to adapt the materials of the turbine to this increase in temperature, by improving techniques for cooling turbine blades and vanes (hollow blades and vanes) and/or by improving the properties of those materials for withstanding high temperatures. This second technique, used in combination with superalloys based on nickel and/or cobalt, has led to several solutions, including solutions involving depositing a thermally insulating coating on the superalloy substrate, which coating is known as a "thermal barrier" and is made up of a plurality of layers.

The use of thermal barriers in aeroengines has become widespread over the last thirty years, and it enables the temperature of the gas at the inlet to the turbines to be increased, the stream of cooling air to be reduced, and thus the efficiency of engines to be improved.

Specifically, the insulating coating serves to establish a temperature gradient through the coating on a cooled part under steady operating conditions that has a total amplitude that may exceed 100° C. for a coating having a thickness of about 150 micrometers (μm) to 200 μm and that presents conductivity of 1.1 watts per meter per kelvin ($W.m^{-1}.K^{-1}$). The operating temperature of the underlying metal forming the substrate for the coating is thus decreased by the same gradient, thereby giving rise to considerable savings in the volume of cooling air that is needed and to considerable increases both in the lifetime of the part and also in the specific consumption of the turbine engine.

It is known to have recourse to using a thermal barrier comprising a layer of ceramic based on zirconia stabilized with yttrium oxide, i.e. yttrium-stabilized zirconia having a molar content of yttrium oxide lying in the range 4% to 12% (and in particular in the range 6% to 8%), and that presents a coefficient of expansion that is different from that of the superalloy constituting the substrate, with thermal conductivity that is quite low.

Among the coatings used, mention may be made of the fairly widespread use of a layer of ceramic based on zirconia that is partially stabilized with yttrium oxide, e.g. $Zr_{0.92}Y_{0.08}O_{1.96}$.

In order to anchor this ceramic layer, a metal underlayer having a coefficient of expansion that ideally is close to that of the substrate is generally interposed between the substrate of the part and the ceramic layer. In this way, the metal underlayer serves firstly to reduce the stress due to the difference between the coefficients of thermal expansion of the ceramic layer and of the substrate-forming superalloy.

The underlayer also provides adhesion between the substrate of the part and the ceramic layer, it being understood that adhesion between the underlayer and the substrate of the part takes place by interdiffusion, and adhesion between the underlayer and the ceramic layer takes place by mechanical anchoring and by the propensity of the underlayer to develop a thin oxide layer at high temperature at the ceramic/underlayer interface, which oxide layer provides chemical contact with the ceramic.

In addition, the metallic underlayer provides the superalloy of the part with protection against corrosion and oxidation phenomena (the ceramic layer is permeable to oxygen).

Specifically, it is known to use an underlayer constituted by nickel aluminide including a metal selected from platinum, chromium, palladium, ruthenium, iridium, osmium, rhodium, or a mixture of those metals, and/or a reactive element selected from zirconium (Zr), cerium (Ce), lanthanum (La), titanium (Ti), tantalum (Ta), hafnium (Hf), silicon (Si), and yttrium (Y).

By way of example, a coating of the (Ni,Pt)Al type is used in which platinum is inserted in the nickel lattice of β-NiAl metallic compounds.

When preparing thermal barriers, platinum performs two functions: it acts as a diffusion barrier to prevent interdiffusion of aluminum from the layer to the substrate. Furthermore, platinum aluminide increases the resistance to corrosion at high temperature and the adhesion of protective layers. However, platinum aluminide coatings degrade quickly at 1100° C.: there exist phase transformations associated with interdiffusion of the elements of the coating and of the substrate.

Under such circumstances, the metallic underlayer may be constituted by a platinum modified nickel aluminide NiPtAl using a method that comprises the following steps: preparing the surface of the part by chemical cleaning and sand-blasting; electrolytically plating a coating of platinum (Pt) on the part; optionally heat-treating the result in order to cause Pt to diffuse into the part; using chemical vapor deposition (CVD) or physical vapor deposition (PVD) to deposit aluminum (Al); optionally heat-treating the result to cause Pt and Al to diffuse into the part; preparing the surface of the metallic underlayer as formed in this way; and using electron beam physical vapor deposition (EB-PVD) to deposit a ceramic coating.

Platinum is thus deposited electrolytically before the thermochemical treatment of vapor phase aluminization.

It should be recalled that electroplating serves to reduce onto a conductive part (the cathode) a metallic complex initially present in the solution by causing an electric current to flow from an anode (an electrode where an oxidation reaction takes place) to a cathode onto which deposition (plating) takes place (and at which other reduction reactions may take place simultaneously).

Solutions of various compositions are commercially available for platinum plating. The pH of such solutions may be basic, acidic, or neutral.

The compounds obtained at the end of platinum extraction are ammonium hexachloroplatinate (IV): $(NH_4)_2PtCl_6$ or potassium hexachloroplatinate (IV): $K_2PtCl_6$. The main compounds of platinum present in platinum plating baths are derived from transforming those compounds.

Ignoring degree of oxidation 0 which corresponds to the metal, there are two other degrees of oxidation: +II and +IV, which correspond to complex species. Depending on the nature of the ligands in solution suitable for forming complexes with the metallic cations in solution, the stability and the reactivity of the complex will vary.

Numerous formulations of electrolyte baths for platinum plating have already been proposed, and they comprise various chemical species in aqueous solution, imparting its properties on the bath.

Nevertheless, numerous drawbacks persist. In particular, the baths of electrolyte that have been proposed are of significant cost, in particular because of the cost of the chemicals used to regenerate them. Furthermore, the possibility of regeneration is limited and leads to the bath having a lifetime that is short, since it presents technical characteristics that are not stable and that degrade with aging of the bath.

An object of the present invention is to provide an electrolyte bath for plating platinum on a metal substrate, which electrolyte bath presents improved technical performance, in particular plating parameters and conditions that are identical or practically identical regardless of the shape of the part, a deposition rate that is identical or practically identical regardless of the applied current density, deposition quality that complies with specifications, and an improved lifetime.

To this end, according to the present invention, the method of fabricating a bath of electrolyte is characterized in that it comprises the following steps:

a) providing a first system having ligands and amine functional groups, said first system being constituted by an aqueous solution of an amino ligand comprising at least one compound $X—(NH_2)_n$, where X belongs to the group constituted by ($CH_3$, $CH_3—CH_2$, $CH_3—(CH_2)_m$), or $NH_3$ or an $x^{p-}(NH_4)^+_p$ salt where x is an acid radical belonging to the group constituted by ($PO_4^{3-}$, $HPO_4^{2-}$, $H_2PO_4^-$, $HPO_4^{2-}$and $H_2PO_4^-$, $SO_4^{2-}$, $HSO_4^-$, $HSO_4^-$, and $H_2SO_4$, $CH_3COO^-$, $CH_3COOH$, and $CH_3COO^-$), or $H_2SO_4$, or $CH_3COOH$, and where n, m, and p are non-zero integers;

b) providing a second system forming a buffer system;

c) providing a third system providing a metallic salt, and constituted by an aqueous solution of platinum;

d) providing a fourth system suitable for imparting the property of conduction to the medium; and e) mixing together the four systems so as to obtain the said electrolyte bath.

BRIEF DESCRIPTION OF THE DRAWINGS

A more complete appreciation of the invention and of the attendant advantages thereof will be readily obtained as the same become better understood by reference to the following detailed description when considered in connection with the accompanying drawings wherein.

Figure 1A:
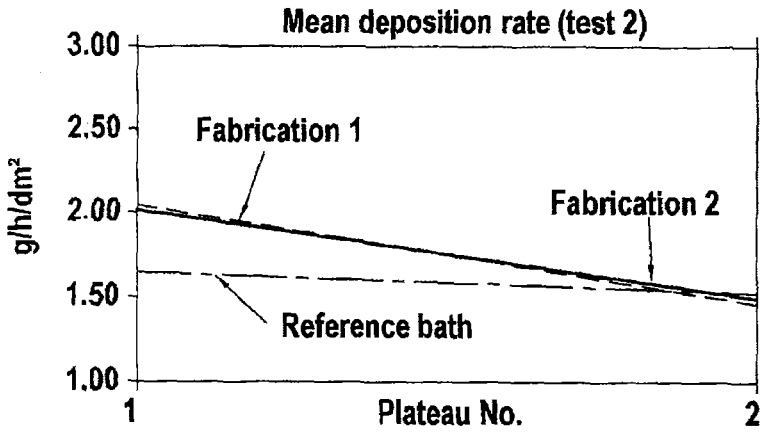
FIGS. 1A-1C depict performance of test 2.
Figure 1B:
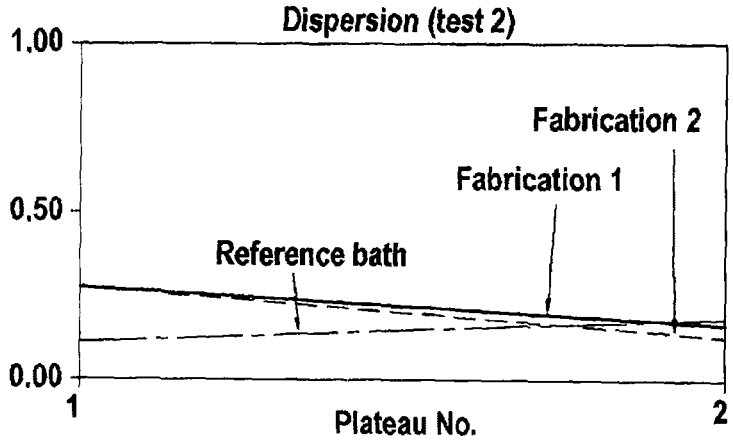
Figure 1C:
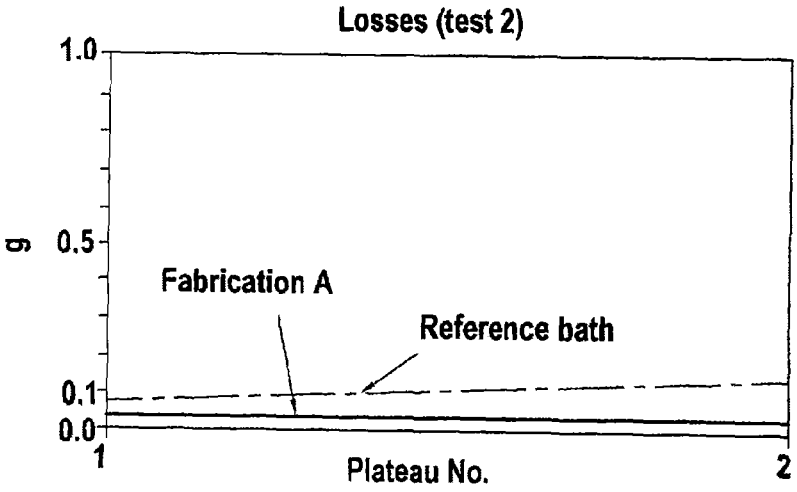
Figure 1D:
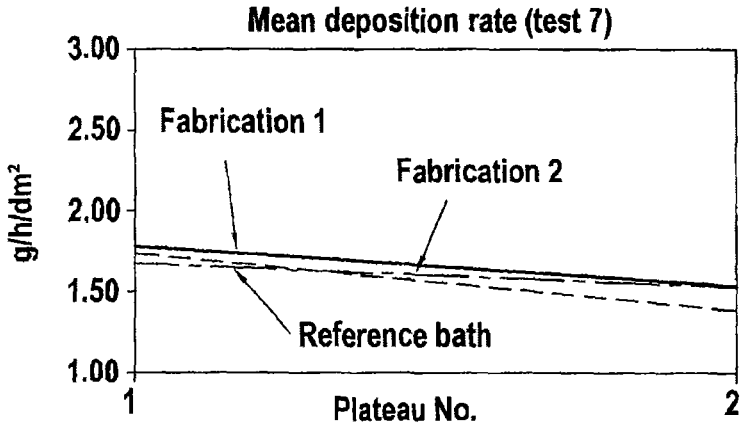
FIGS. 1D-1F depict performance of test 7.
Figure 1E:
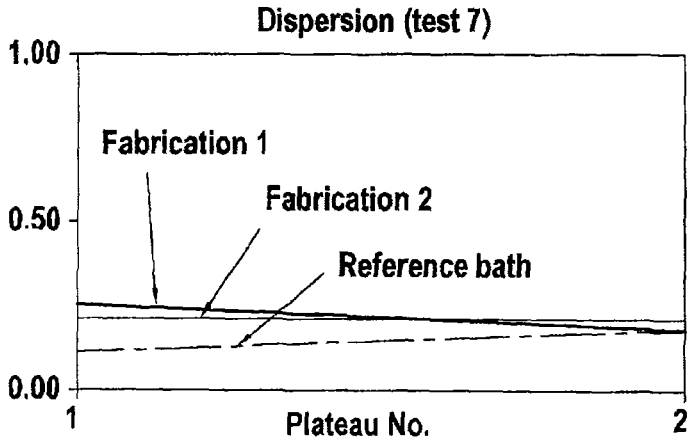
Figure 1F:
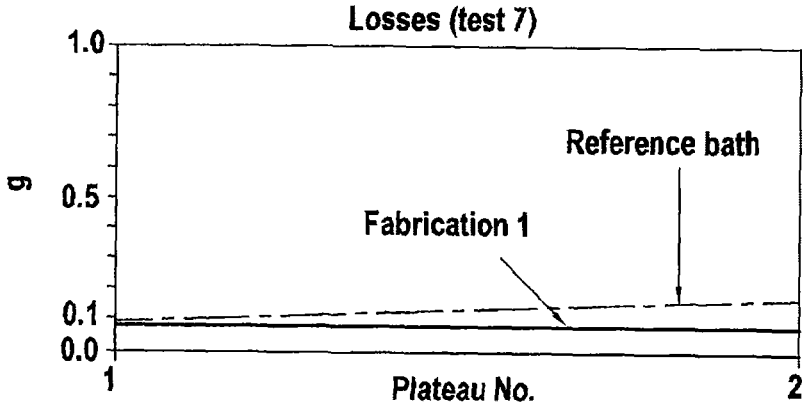
Figure 1G:
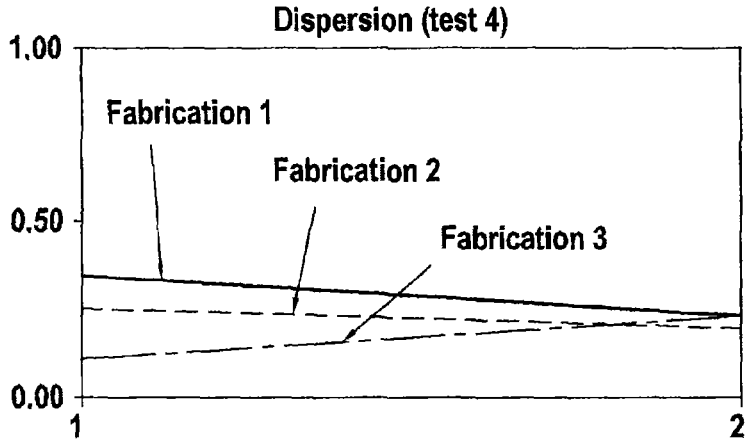
FIGS. 1G-1I depict performance of test 4.
Figure 1H:
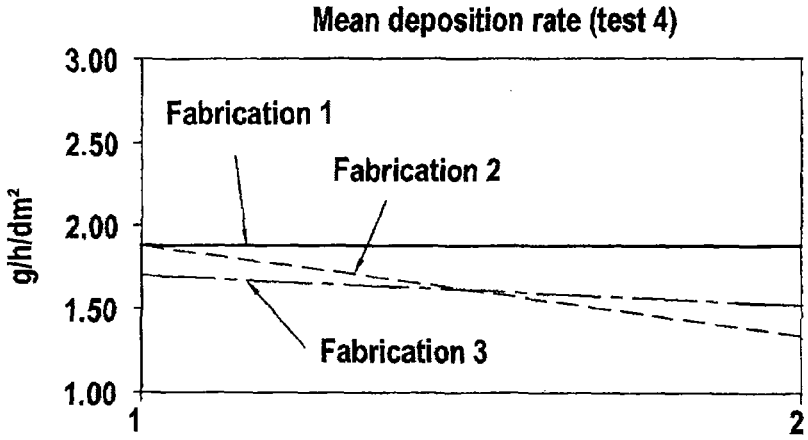
Figure 1I:
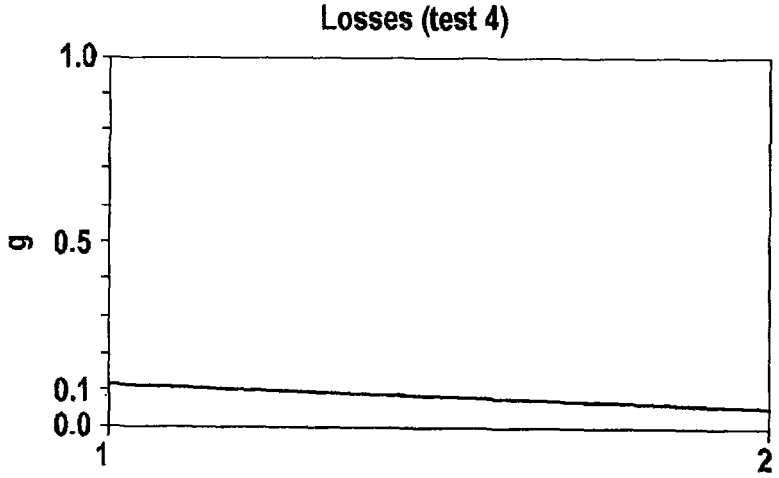

In this way, it can be understood that preference is given to using a complex that results from bonding between an amino ligand and a platinum-based metallic salt. In particular, a ligand is chosen without a carbon chain and with only one amine function: ($NH_3$ (ammonia) or an $xNH_4^+$ salt or an ammonium $X—NH_2$) where X is selected either as an inert molecule that is not involved in the main reaction, or else as a molecule that interacts in the formulation reaction.

Preferably, the metallic salt of the third system is selected from salts of platinum of degree of oxidation IV.

This solution also presents the additional advantage of making it possible to use salts of platinum of degree of oxidation IV, which are much more stable than salts of platinum of degree of oxidation II.

Overall, by means of the solution of the present invention, it is possible to provide an electrolyte bath that presents improved lifetime, with plating properties that remain satisfactory and stable over time.

Also according to the invention, the first system, the second system, and the fourth system are grouped together in a single solution forming a first solution B.

Advantageously, the first solution B includes an $x^{p-}(NH_4)^+_p$ salt, where $x=HPO_4^{2-}$ and p=2, and/or $x=H_2PO_4^-$ and p=1.

Preferably, the first system forms a solution A constituted by an aqueous solution of platinum, including sodium hydroxide (NaOH) and at least one salt of platinum of degree of oxidation IV.

Under such circumstances, and preferably, the molar ratio of the quantity of sodium hydroxide (NaOH) to the quantity of salt of platinum of degree of oxidation IV is 2.

Also according to the invention, during step c), the third system forms a second solution A constituted by an aqueous solution of platinum comprising sodium hydroxide (NaOH) and at least one salt of platinum of degree of oxidation IV, and during step e), the following substeps are performed:

e1) covering the first solution B and raising its temperature to at least 50° C. for at least 1 h30; and e2) mixing the second solution A with the first solution B to form an electrolyte bath including a platinum amino complex.

In a preferred implementation, after step e), a step f) is performed during which said bath of electrolyte is heated to a temperature lying in the range 80° C. to 97° C. for at least two hours; and then a step g) is performed during which a deposit of platinum is electroplated on a metallic substrate using said bath of electrolyte.

Furthermore, in the invention, during substep e2), the second solution A is added into the first solution B.

Under such circumstances, and advantageously, prior to substep e2), the first solution B is raised to a temperature of 60° C.

Preferably, said salt of platinum of degree of oxidation IV is defined by $Y_2PtM_6$ with $Y=NH_4^+$, $H^+$, or $K^+$, and $M=Cl^-$ or $OH^-$.

Advantageously, in the second solution A, said salt of platinum of degree of oxidation IV is diammonium hexachloroplatinate of formula $(NH_4)_2PtCl_6$.

Advantageously, in the first system, said $x^{p-}(NH_4)^+_p$ amine compound comprises diammonium hydrogen phosphate $(NH_4)_2HPO_4$ and/or ammonium dihydrogen phosphate $NH_4H_2PO_4$.

In a preferred formulation, the first system includes diammonium hydrogen phosphate $(NH_4)_2HPO_4$ and ammonium dihydrogen phosphate $NH_4H_2PO_4$ with a molar ratio of 2 between the quantity of ammonium dihydrogen phosphate $NH_4H_2PO_4$ and the quantity of diammonium hydrogen phosphate $(NH_4)_2HPO_4$.

One or another or several of the following provisions is/are also preferably adopted:

the first solution B provided in step a) is obtained with water presenting a temperature of about 30° C.;

the second solution A provided in step c) is obtained with water presenting a temperature of about 45° C.;

during step b), the temperature of the first solution B is raised to at least 50° C. for at least 3 h30; and during step d), said bath of electrolyte is raised to a temperature of at least 80° C. for at least three hours (e.g. 85° C. for 3 h).

The present invention also provides a method of fabricating a platinum-based metal underlayer from the bath of electrolyte obtained by the above-described fabrication method, characterized in that it comprises the following steps:

f) providing a metallic substrate, in particular a substrate made of superalloy;

g) heating said bath of electrolyte; and h) electroplating a deposit of platinum on said metallic substrate using said bath of electrolyte.

The present invention also provides a set of solutions for fabricating a bath of electrolyte for making a platinum-based metallic underlayer on a metallic substrate, the set being characterized in that it comprises:

a first solution B constituted by an aqueous solution of an amino ligand comprising at least one compound $X—(NH_2)_n$, where X belongs to the group constituted by ($CH_3$, $CH_3—CH_2$, $CH_3—(CH_2)_m$), or $NH_3$ or an $x^{p-}(NH_4)^+_p$ salt where x is an acid radical belonging to the group constituted by ($PO_4^{3-}$, $HPO_4^{2-}$, $H_2PO_4^-$, $HPO_4^{2-}$and $H_2PO_4^-$, $SO_4^{2-}$, $HSO_4^-$, $HSO_4^-$, and $H_2SO_4$, $CH_3COO^-$, $CH_3COOH$, and $CH_3COO^-$), or $H_2SO_4$, or $CH_3COOH$, and where n, m, and p are non-zero integers; and a second solution A constituted by an aqueous solution of platinum, including sodium hydroxide (NaOH) and at least one salt of platinum of degree of oxidation IV.

Preferably, in the second solution A, said salt of platinum of degree of oxidation IV is defined by $Y_2PtM_6$ with $Y=NH_4^+$, $H^+$, or $K^+$, and $M=Cl^-$or $OH^-$.

Advantageously, said salt of platinum of degree of oxidation IV is diammonium hexachloroplatinate of formula $(NH_4)_2PtCl_6$.

Preferably, the molar ratio of the quantity of sodium hydroxide (NaOH) to the quantity of salt of platinum of degree of oxidation IV is 2.

In a preferred implementation, in the first solution B, said $x^{p-}(NH_4)^+_p$ amine compound comprises diammonium hydrogen phosphate $(NH_4)_2HPO_4$ and/or ammonium dihydrogen phosphate $NH_4H_2PO_4$.

In a preferred variant, the first solution B includes diammonium hydrogen phosphate $(NH_4)_2HPO_4$ and ammonium dihydrogen phosphate $NH_4H_2PO_4$ with a molar ratio of 2 between the quantity of ammonium dihydrogen phosphate $NH_4H_2PO_4$ and the quantity of diammonium hydrogen phosphate $(NH_4)_2HPO_4$.

Finally, the invention also provides the bath of electrolyte that results from the fabrication method of the invention. Such a bath of electrolyte for making a platinum-based metallic underlayer on a superalloy substrate is characterized in that it includes an amino complex of platinum with the wavelength of a $Pt—NH_3$ or $Pt—NH_2$ bond and a buffer solution.

Other advantages and characteristics of the invention appear on reading the following description made by way of example and with reference to the accompanying drawings, in which:

FIGS. 1A to 1I, 2A and 2B are various plots showing the characteristics and the behavior of various electrolytic baths fabricated using the fabrication method of the invention.

An electrolytic bath makes it possible to deposit (i.e. electroplate) platinum using a technique that is particularly ecological and economic (performed in a short length of time, and performed under atmospheric pressure, thereby avoiding evacuation equipment) compared with techniques of chemical vapor deposition (CVD) or thermal sputtering.

In addition, this plating method is compatible for use with parts having holes: the shape of the lines of current prevent any significant deposition taking place inside the holes, and in particular inside cooling holes of small size, which holes are thus not obstructed.

It should also be observed that using such a method avoids having recourse to dangerous chemicals and to producing toxic waste.

EXAMPLE 1

In this example, the bath is formulated from four ingredients organized as two distinct solutions A and B that are heated and stirred separately in order to cause the ingredients to react within each of the solutions, prior to mixing together the two solutions A and B.

Thereafter, the mixture of the two solutions A and B is heated and stirred. Once the time for heating the A+B mixture has elapsed, the platinum electroplating bath is ready for use in performing electroplating.

In particular, solution A includes, amongst other ingredients, the platinum salt(s) and solution B is the solution that contains, amongst other ingredients, the ligands (it should be recalled that a ligand is an ionic or molecular chemical entity carrying chemical functions that enable it to bond with one or more metallic entities, generally a cation, with the association of a metallic entity and one or more ligands forming a structure that is soluble in solution and known as a complex).

To fabricate one liter of electrolytic bath with 8 grams (g) of platinum per liter, the procedure is as follows:

Preparing solution B: in 300 milliliters (mL) of distilled water (<500 ohms (Ω)) at 30° C., place 44.0 g of diammonium hydrogen phosphate having the chemical formula $(NH_4)_2HPO_4$ (i.e. 0.33 moles) and 75.0 g of ammonium dihydrogen phosphate of chemical formula $NH_4H_2PO_4$ (i.e. 0.65 moles). The molar ratio between the quantity d of ammonium dihydrogen phosphate and the quantity of diammonium hydrogen phosphate is 2. Once the salts have dissolved, cover the solution and raise to 50° C. during 4 hours (h) 30 minutes (min).

Preparing solution A: in 300 mL of distilled water at 45° C., place 5 g of sodium hydroxide of chemical NaOH (i.e. 0.080 moles) and 18.3 g of the platinum salts diammonium hexachloroplatinate of formula $(NH_4)_2PtCl_6$ (i.e. 0.040 moles). The molar ratio between the quantity of sodium hydroxide and the quantity of diammonium hexachloroplatinate salt is 2. Allow the platinum salts to dissolve within solution A.

Once solution B is ready and hot, prepare solution A and add it to solution B, after raising it to 60° C.

To finish, raise the A+B mixture (of pH previously adjusted to 6.3 by adding a basic solution such as, for example, sodium hydroxide, potassium hydroxide, sodium triphosphate) to 85° C. for 3 h. All of the solutions should be covered during the heating steps.

More generally, with this solution B including diammonium hydrogen phosphate of chemical formula $(NH_4)_2HPO_4$ and ammonium dihydrogen phosphate of chemical formula $NH_4H_2PO_4$, the pH of the mixture of the solutions A+B should be set to lie in the range 6 to 10, and preferably in the range 6 to 7.

In the context of this formulation, and in order to identify the best operating conditions for performing platinum electroplating, an experimental design with nine baths was performed using different temperatures and times for heating solution B and then the A+B mixture, as specified in Table 1 below, with test 2 corresponding to the above-specified procedure:

TABLE 1

| Test No. | B heat temp (° C.) | B heat time (h) | AB heat temp (° C.) | AB heat time (h) |
|---|---|---|---|---|
| 1 | 50° C. | 1 h 30 | 50° C. | 1 h |
| 2 | 50° C. | 4 h 30 | 85° C. | 3 h |
| 3 | 50° C. | 8 h | 95° C. | 8 h |
| 4 | 85° C. | 1 h 30 | 85° C. | 8 h |
| 5 | 85° C. | 4 h 30 | 95° C. | 1 h |
| 6 | 85° C. | 8 h | 50° C. | 3 h |
| 7 | 95° C. | 1 h 30 | 95° C. | 3 h |
| 8 | 95° C. | 4 h 30 | 50° C. | 8 h |
| 9 | 95 C. | 8 h | 85° C. | 1 h |

For each formulated bath, test pieces were plated with platinum at different currents. Each test piece was weighed before and after plating.

On the basis of the increase in weight, it was thus possible to determine:

deposition rate (in grams per hour per square decimeter ($g/h/dm^2$)) at each current;

the plateau of the bath;

the current at the beginning of the plateau;

the mean deposition rate of the plateau;

the standard deviation of the plateau; and the ratio between the minimum and maximum rates obtained over the plateau.

The three tables 2-1 to 2-3 below give the results obtained with the three baths that were found to give the best results at the end of the experiment.

TABLE 2-1

| Experimental parameters | | | | | |
|---|---|---|---|---|---|
| | B heat temp (° C.) | B heat time (h) | AB heat temp (° C.) | AB heat time (h) | Color of bath after heating |
| Test 2 | 50° C. | 4 h 30 | 85° C. | 3 h | Clear |
| Test 4 | 85° C. | 1 h 30 | 85° C. | 8 h | Clear |
| Test 7 | 95° C. | 1 h 30 | 95° C. | 3 h | Clear |

TABLE 2-2

| Deposition rate ($g/h/dm^2$) | | | | | | |
|---|---|---|---|---|---|---|
| | 8A | 1A | 4A | 16A | 24A | 8A |
| Test 2 | 2.4455 | 0.8164 | 1.9618 | 2.2618 | 2.2564 | 1.6127 |
| Test 4 | 2.0782 | 0.1727 | 1.4982 | 2.0236 | 2.2891 | 1.4945 |
| Test 7 | 2.0509 | 0.6782 | 1.5600 | 2.1164 | 1.9073 | 1.5109 |

TABLE 2-3

| Plateau characteristics | | | | | |
|---|---|---|---|---|---|
| | Color of bath after electrolysis | Start of plateau | Mean rate of plateau ($g/h/dm^2$) | Plateau standard deviation | Vmin/Vmax ratio of plateau |
| Test 2 | Clear | 4A | 2.0232 | 0.27 | 0.65 |
| Test 4 | Cloudy | 4A | 1.8264 | 0.34 | 0.79 |
| Test 7 | Cloudy | 4A | 1.7736 | 0.25 | 0.61 |

Furthermore, the bath of test 2 provides the following advantages:

This is the bath for which the greatest degree of repeatability was observed, and which, compared with a reference bath, the mean deposition rate was large for a new bath (FIG. 1A), and remained sufficiently high during operation (FIG. 1A). The bath of test 2 is repeatable since the curve for mean rate and for dispersion of fabrications 1 and 2 are superposable, which clearly demonstrates the extreme degree of reproducibility of the fabrication. In contrast, it can be seen that the fabrication curves 1 and 2 for the bath of test 7 and even more for the bath of test 4 can be distinguished, so the bath of test 4 is the least repeatable, which is why bath 4 is not preferred.

Furthermore, the bath of test 2 presents good dispersion of the plateau (FIG. 1B), it being recalled that the presence of a "plateau" corresponds to obtaining a deposition rate that is identical regardless of the applied current and regardless of the shape of the part being treated. On each fabrication, two plateaus were implemented. One plateau was studying the gain in weight as a function of the applied current density. In in-house fabrications, the dispersion decreases with increasing amount of electrolysis performed in the bath. This is not true of the reference bath where the bath becomes increasingly dispersed with increasing number of electrolyses performed.

Likewise, it can be seen that the bath of test 2presents little loss of platinum over time (FIG. 1C) and that the mean effectiveness (FIG. 2A) and the deposition rate (FIG. 2B) of the bath are practically identical after three successive regenerations. Concerning losses of platinum, we found numerous loses of platinum with the reference bath, mainly in the form of a solid precipitate of platinum on the bottom of the vessel. Furthermore, with the reference bath, the greater the number of electrolyses performed using the bath, the greater its tendency to form precipitates on the bottom of the vessel. In contrast, for baths of the invention, it is observed that platinum losses are smaller, and above all constant over time (constant with increasing number of electrolyses). Furthermore, the bath of test 2 is the bath that presented the smallest loses of platinum and thus the bath of test 2 is the most profitable from an economic point of view.

Overall, and as can be seen from the curves of FIGS. 1D to 1F and 1G to 1I, the baths of tests 4 and 7give results that are very similar to those of test 2.

Figure 2A:
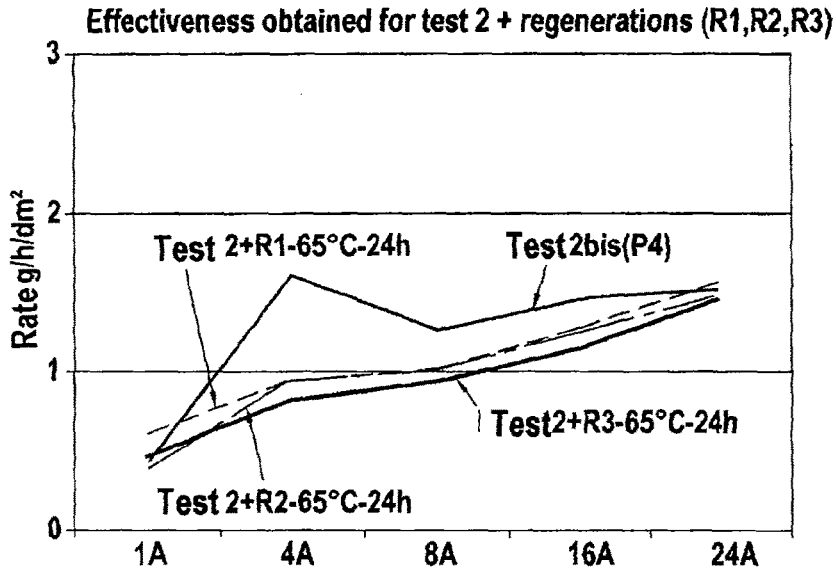
FIGS. 2A and 2B depict the stability of test 2 over time.
Figure 2B:
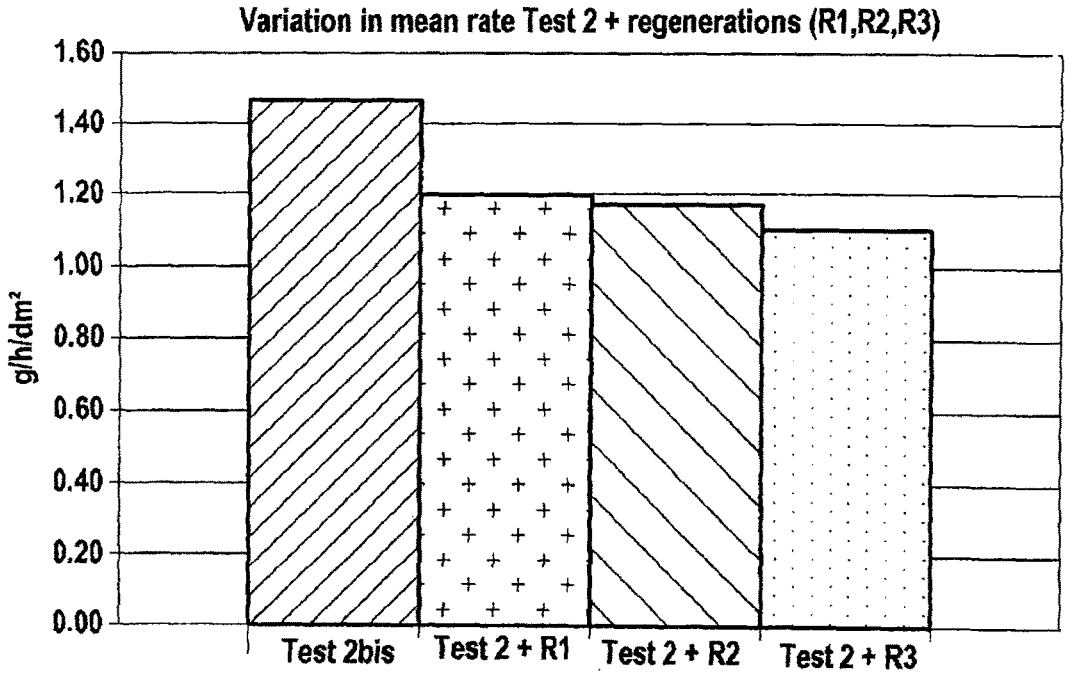

Furthermore, as can be seen from FIGS. 2A and 2B, the electrolyte bath of test 2 gives results that are stable over time in terms of deposition rate, with this continuing after the bath has been regenerated several times: the deposition rate is practically unchanged between the first and third regenerations.

In order to regenerate a bath, platinum salts are added to the bath so as to raise its platinum content. Once the platinum salts have been added, the bath is left while being stirred at 65° C. for 12 h to 24 h so that the salts become fully dissolved in the bath.

EXAMPLE 2

The fabrication of the bath of electrolyte is analogous to that of the procedure of Example 1, apart from the following points.

Solution B comprises 43.5 g of ammonium hydrogen sulfate of chemical formula $NH_4HSO_4$ and 76 g of diammonium sulfate of chemical formula $(NH_4)_2SO_4$, and water. It was raised to 50° C. for 4h30.

The pH of the mixture of solutions A+B was set in the range 1 to 5.

EXAMPLE 3

The fabrication of the bath of electrolyte is analogous to that of the recipe of Example 1, apart from the following points.

Solution B comprises 102.4 g of ammonium acetate of chemical formula $CH_3COONH_4$ and 39.6 g of acetic acid of chemical formula $CH_3COOH$.

The solution was raised to 50° C. for 4h30.

The pH of the mixture of the solutions A+B was set to lie in the range 1 to 5.

In the invention, the ligand is preferably selected from aliphatic polyamines having 3 to 20 carbon atoms in a straight or branched carbon chain.

Advantageously, the ligand is selected from primary polyamines such as diaminopropanes such as 1,3-diaminopropane and 1,2-diaminopropane, diethylenetriamine, 1,4-diaminobutane, 1,6-diaminohexane; secondary polyamines such as N,N' dimethyl-1,3-propane-diamine; and tertiary polyamines such as N, N, N', N' tetramethylethylenediamine. It is preferred to select diaminopropanes for the ligands.

The invention claimed is:

1. A fabrication method for a bath of electrolyte, the method comprising:

a) providing a first system having ligands and amine functional groups, said first system comprising an aqueous solution of an amino ligand comprising:

(i) at least one compound $X—(NH_2)_n$, where X is selected from the group consisting of ($CH_3$, $CH_3—CH_2$, $CH_3—(CH_2)_m$;

(ii) $NH_3$; or (iii) an $x^{P-}(NH_4)^+_p$ salt where x is an acid radical selected from the group consisting of $PO_4^{3-}$, $HPO_4^{2-}$, $H_2PO_4^-$, $SO_4^{2-}$, $HSO_4^-$, and $CH_3COO-$, where n, m, and p are non-zero integers;

b) providing a second system forming a buffer system;

c) providing a third system providing a metallic salt, and comprising an aqueous solution of platinum; the metallic salt being at least one salt of platinum of degree of oxidation IV;

d) providing a fourth system suitable for imparting the property of conduction to the bath of electrolyte;

forming a first solution B by grouping the first system, the second system, and the fourth system together in a single solution;

forming a second solution A comprising sodium hydroxide and the least one salt of platinum of degree of oxidation IV of the third system; and e) mixing together the four systems so as to obtain the electrolyte bath of electrolyte;

wherein the mixing comprises:

e1) covering the first solution B and raising the first solution B to a temperature of at least 50° C. for at least 1h30 and e2) adding the second solution A to the first solution B and mixing the second solution A with the first solution B thereby forming a platinum amino complex and thus obtaining said bath of electrolyte.

2. The method according to claim 1, the first solution B comprises the $x^{p-}(NH_4)^+_p$ salt, where $x=HPO_4^{2-}$ and p=2, and/or $x=H_2PO_4^-$ and p=1.

3. The method according to claim 2, further comprising f) heating the bath of electrolyte to a temperature of 80° C. to 97° C. for at least two hours; and g) electroplating a deposit of platinum on a metallic substrate using said heated bath of electrolyte.

4. The method according to claim 3, wherein prior to e2), the first solution B is raised to a temperature of 60° C.

5. The method according to claim 3, wherein the molar ratio of sodium hydroxide (NaOH) to the salt of platinum of degree of oxidation IV is 2.

6. The method according to claim 1, wherein said salt of platinum of degree of oxidation IV is $Y_2PtM_6$ with $Y=NH_4^+$, $H^+$, or $K^+$, and $M=Cl^-$ or $OH^-$.

7. The method according to claim 6, wherein in the second solution A, said salt of platinum of degree of oxidation IV is diammonium hexachloroplatinate of formula $(NH_4)_2PtCl_6$.

8. The method according to claim 1, wherein x of the $x^{p-}(NH_4)^+_p$ salt is an acid radical selected from the group consisting of $HPO_4^{2-}$ and $H_2PO_4^-$; and wherein the first system comprises diammonium hydrogen phosphate $(NH_4)_2HPO_4$, ammonium dihydrogen phosphate $NH_4H_2PO_4$, or a mixture thereof.

9. The method according to claim 8, wherein a molar ratio between the ammonium dihydrogen phosphate $NH_4H_2PO_4$ and the diammonium hydrogen phosphate $(NH_4)_2HPO_4$ is 2.

10. The method according to claim 1, wherein said second solution A is heated before step e2).

* * * * *